US005557069A

United States Patent [19]

Whitehead et al.

[11] Patent Number: 5,557,069

[45] Date of Patent: Sep. 17, 1996

[54] ELECTRICAL SPRING CONNECTOR HAVING IMPROVED SHELL FOR CONTROLLING SPRING EXPANSION

[75] Inventors: James H. Whitehead, Collierville; Francis X. Lynch, Memphis, both of Tenn.

[73] Assignee: Thomas & Betts Corporation, Memphis, Tenn.

[21] Appl. No.: 268,396

[22] Filed: Jun. 30, 1994

[51] Int. Cl.[6] ..... H01R 4/22

[52] U.S. Cl. ..... 174/87; 174/138 F; 403/376

[58] Field of Search ..... 174/87, 138 F; 403/396

[56] References Cited

U.S. PATENT DOCUMENTS

| | | | |
|---|---|---|---|
| 3,297,816 | 1/1967 | Waddington | 174/87 |
| 3,350,499 | 10/1967 | Swanson | 174/87 |
| 3,483,310 | 12/1969 | Krup | 174/87 |
| 3,497,607 | 2/1970 | Swanson | 174/87 |
| 3,519,707 | 7/1970 | Krup | 174/87 |
| 3,614,296 | 10/1971 | Blomstrand | 174/87 |
| 3,676,574 | 7/1972 | Johansson et al. | 174/87 |
| 3,875,324 | 1/1975 | Waddington et al. | 174/87 |
| 3,902,005 | 8/1975 | Norden | 174/87 |
| 4,104,482 | 8/1978 | Scott | 174/87 |
| 4,112,251 | 9/1978 | Scott | 174/87 |
| 4,220,811 | 9/1980 | Scott | 174/87 |
| 4,227,040 | 10/1980 | Scott | 174/87 |
| 4,288,657 | 9/1981 | Swanson | 174/87 |
| 4,451,695 | 5/1984 | Fink | 174/87 |
| 4,691,079 | 9/1987 | Blaha | 174/87 |
| 4,883,921 | 11/1989 | Legerius et al. | 174/87 |
| 5,023,401 | 6/1991 | Clifton | 174/87 |
| 5,308,922 | 5/1994 | Wallace et al. | 174/87 |

*Primary Examiner*—Kristine L. Kincaid
*Assistant Examiner*—Chau N. Nguyen
*Attorney, Agent, or Firm*—Michael L. Hoelter; Salvatore J. Abbruzzese

[57] ABSTRACT

A twist-on electrical connector connects plural conductors, preferably stripped ends of insulated conductors. The connector includes an outer insulative shell having a cavity open at one end. The cavity supports an expandable generally conical spring which accommodates the conductors. The shell includes plural ribs extending into the cavity for engagement with the spring upon radial expansion thereof. The ribs have tapered extents so that the ribs deform in both the radial and transverse direction upon expansion of the spring to control the rate of spring expansion.

13 Claims, 4 Drawing Sheets

ELECTRICAL SPRING CONNECTOR HAVING IMPROVED SHELL FOR CONTROLLING SPRING EXPANSION

FIELD OF THE INVENTION

The present invention relates generally to an electrical connector for twisting onto electrical conductors which may be stripped ends of insulated conductors. More particularly, the present invention relates generally to a twist-on electrical connector having an improved shell configuration which controls the rate of expansion of the conductive spring supported therein.

BACKGROUND OF THE INVENTION

A well known and common product used to connect electrical wires is a twist-on or screw-on wire connector. These connectors are used to connect the stripped ends of two or more insulated or non-insulated conductors. Typically these twist-on wire connectors include a plastic insulating shell and a wire spring supported therein. The wire spring may be conical in shape so that when connector is placed over the stripped ends of insulated electrical conductors and twisted thereon, the conductors are brought into electrical engagement with each other within the spring. In order to accommodate the stripped ends of the electrical conductors in the conical wire spring, the spring is constructed to resiliently radially expand. Such expansion permits two or more conductors to be supported within the conical spring.

Further, the resiliency of the spring securely holds the conductors together in the conical spring establishing electrical connection therebetween. As may be appreciated, mechanical securement of the conductors in the connector as well as the electrical connection therebetween is maintained by the radially inward compressive force exerted by the expanded spring on the terminated conductors. Overexpansion of the spring during termination could cause the loosening of the connector over time, possibly resulting in an open connection between the conductors.

Attempts have been made to control the outward radial expansion of the conical wire spring during termination. One technique is to use the construction of the shell itself to exert a force against the expanding spring to control the rate of expansion of the spring. The prior art has seen numerous shell designs as well as materials to form the shell which attempt to provide such expansion control. U.S. Pat. No. 4,227,040 issued to Scott shows one example of shell modifications which attempt to control the rate of spring expansion. The connector shown in the '040 patent employs a plurality of longitudinally extending ribs spaced about the internal periphery of the shell. The ribs lie in engagement with the outer surface of the conical spring along the length thereof and retard the rate of expansion of the spring. However, it has been found that the particular shape and disposition of the ribs in the '040 patent provide such a degree of resistance to spring expansion that the connector may be difficult to readily twist onto electrical conductors especially in a repetitive installation setting.

In that regard, improvements have also been seen in wire connectors where the outside configuration of the shell is modified to render it easier to twist onto the conductors. One well known technique is to use diametrically opposed outwardly directed wings which fit between the thumb and forefinger of the installer to provide a degree of leverage to permit the twisting of the connector onto the connectors. The above-described '040 patent shows one example of the type of wings known in the prior art. It has been found that while the wings provide additional leverage useful in facilitating twisting of the connector on to the insulated wires, the particular shapes of wings known in the prior art are not ergonometrically comfortable for use by the installer. In situations where the installer has to make numerous such terminations in a short period of time, significant discomfort may be encountered by the installer. It is therefore desirable to provide an improved configuration for the shell which permits the installer to more comfortably terminate conductors with a twist-on wire connector.

SUMMARY OF THE INVENTION

It is an object of the present invention to provide an electrical connector for twisting onto the ends of electrical conductors.

It is a further object of the present invention to provide an electrical spring connector having an outer insulative shell and a wire spring supported therein, the wire spring being radially expandable to accommodate the ends of the electrical conductors.

It is a still further object of the present invention to provide a twist-on electrical connector where the outer insulative shell of the connector serves to control the rate of spring expansion of the spring supported therein.

In the efficient attainment of these and other objects the present invention provides a twist-on electrical connector for connecting the ends of electrical conductors. The connector includes an elongate hollow shell having an inner generally cylindrical shell wall defining a cavity which is open at one end. A radially expandable generally hollow conical wire spring is supported in the cavity for receipt of the ends of the conductors. A plurality of peripherally spaced ribs inwardly radially extend from the inner shell wall for engagement with the wire spring upon expansion thereof to control the degree of radial expansion of the spring. Each rib has a cross-section which tapers radially inwardly terminating in a distal extent. The rib includes an initial spring engagement portion which is proximate to the distal extent of the rib which makes initial contact with the spring upon expansion thereof.

As more particularly shown by way of the preferred embodiment herein, the present invention provides an elongate shell having an open end, a closed end and an elongate axially extending cavity bounded by an inner shell wall. An elongate spring is supported within the cavity. The spring is frictionally attached to the inner shell wall at the opposed end. The spring includes a substantially freely supported longitudinal central portion lying therebetween defining a passage for the ends of the conductors. The central portion of the spring is radially expandable upon insertion of the conductors thereinto. The shell includes a plurality of longitudinally extending deformable ribs, the ribs having a transverse rib base along the shell wall and radially inwardly tapering sides which define a rib peak. The peak is non-aligned with the line of the radius passing centrally through the transverse rib base so as to provide a spring engagement surface along one of the tapering side walls of the rib. This permits the rib to be deformed both in the radial direction and the transverse direction thereby controlling the rate of spring expansion.

DETAILED DESCRIPTION OF THE PREFERRED EMBODIMENTS

Figure 7:
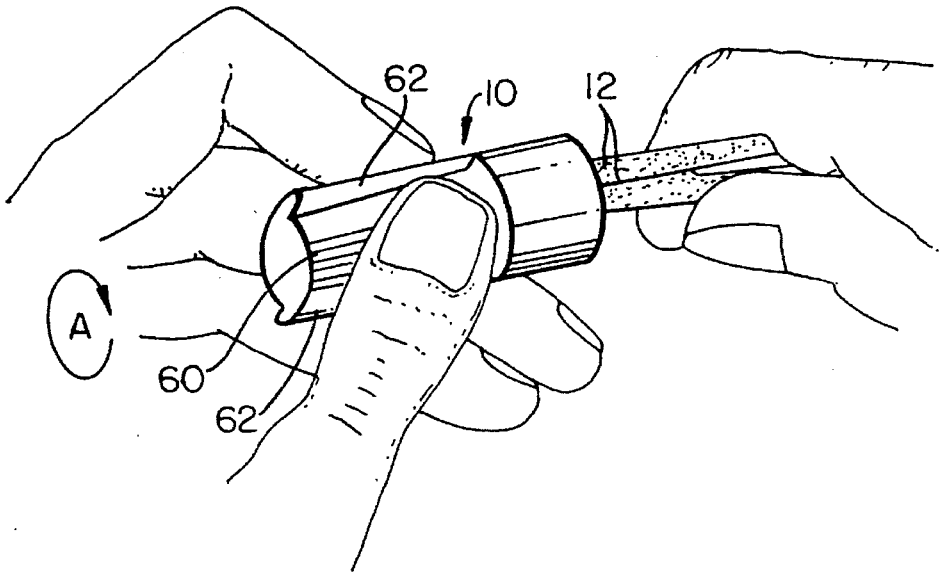
FIG. 7 shows the connector of FIG. 1 being manually installed onto a pair of stripped insulated electrical conductors.

With reference to FIG. 7, a wire connector 10 of the present invention is designed to be twisted onto the exposed stripped ends of electrically insulated conductors 12 to effect electrical connection therebetween. Connector 10 of the present invention is designed to be manually twisted or screwed onto conductors 12 which are held in side-by-side relationship. In a manner which is conventionally known, an installer would hold the connector 10 between the thumb and forefinger of one hand and twist or screw the connector onto the ends of the conductors 12 which may be held in the other hand.

Figure 1:
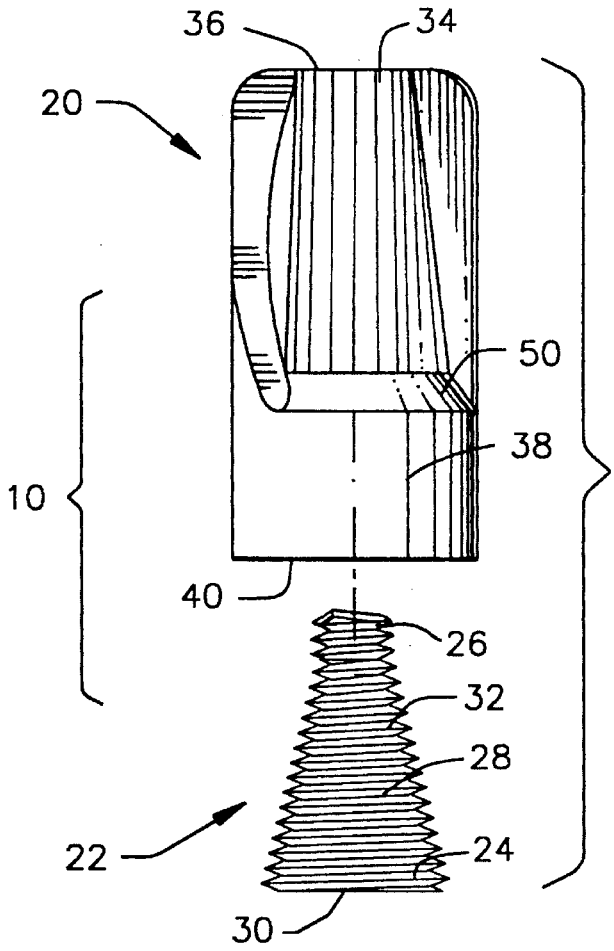
FIG. 1 is an exploded front elevation view of the connector of the present invention including an insulating cap or shell disposed over a coil spring.

Referring now to FIGS. 1, connector 10 of the present invention is shown. Connector 10 is a two component device including an insulating cap or shell 20 and a wire coil spring 22. Shell 20 supports spring 22 therein in a manner which permits radial spring expansion thereof for securement over conductors 12.

Spring 22 is an elongate generally conically shaped member having an open wide end extent 24, an opposed narrow end extent 26 and a tapering central extent 28 therebetween. Spring 22 defines a central passage 30 emanating at wider end extent 24 and terminating at narrow end extent 26. Passage 30 is designed to accommodate the stripped ends of conductors 12. Spring 22 is formed of a continuous helically wound metallic wire 32, which is conductive, although the conductivity of the wire 32 does not necessarily form part of the electrical connection between the conductors 12 that are to be connected. Wire 32 may have a diamond shaped cross-section so as to provide edges thereof which are adapted to cut into conductors 12 upon insertion thereinto enhancing mechanical engagement between the spring 22 and the conductors 12. The shape defined by the outer surface of spring 32 is preferably curved inwardly at the central extent 28, resulting in a waist or narrowed section. Also, in the preferred arrangement, the wire 32 forming spring 22 is plated with a suitable corrosion protection material, such as zinc.

Figure 2:
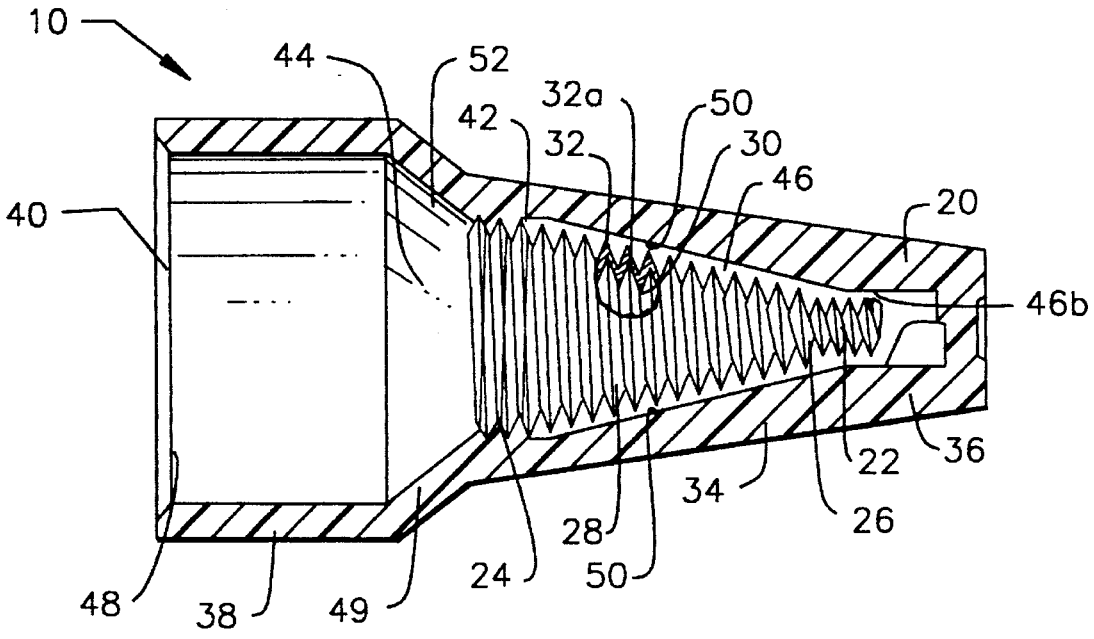
FIG. 2 is a longitudinal cross-section of the connector of FIG. 1 as would be seen along viewing lines II—II of FIG. 4.
Figure 3:
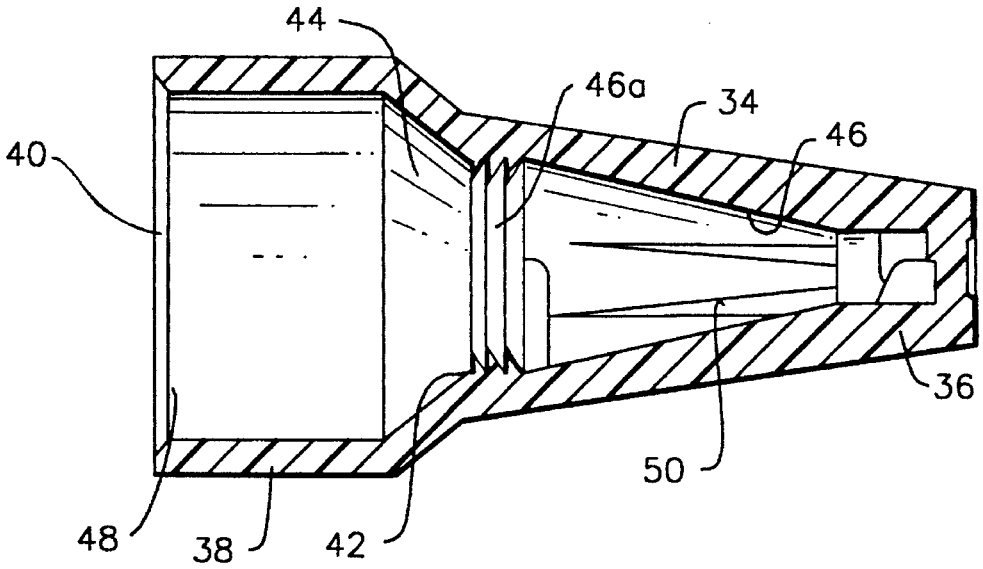
FIG. 3 is a longitudinal cross-section of the connector shell of FIG. 1 taken through the lines III—III of FIG. 4.

Referring to FIGS. 2 and 3, shell 20 is an elongated member formed of a suitably insulative molded thermoplastic material. In the present illustrative embodiment the particular material selected is nylon. Shell 20 generally includes an upper frustro-conically shaped upper portion 34 tapering towards a closed end 36. A wider lower skirt portion 38 is generally cylindrical in shape and includes an open end 40 opposed to closed end 36. The interior wall 42 of shell 20 defines an elongate bore 44 extending from closed end 36 to and communicating with open end 40. Bore 44 is generally divided into two bore sections; a first tapering bore section 46 coextensive with upper portion 34 and a wider cylindrical bore section 48 coextensive with lower portion 38. A centrally disposed tapered transition region 49 facilitates transition between wider lower skirt portion 38 and narrower upper portion 34 of shell 20. Similarly, bore 44 includes a centrally located tapered transition bore region 52 between tapering bore section 46 and cylindrical bore section 48.

As particularly shown with respect to FIG. 2 spring 22 is supported within bore 44 of shell 20. In order to provide such securement a lower extent **46*a* of first tapering bore section 46 is screw-threaded (FIG. 3) in a manner which generally matches the pitch of helically wound wire 32 forming spring 22. Thus, spring 22 may be screw inserted into shell 20 to provide securement therein. While threaded portion 46*a* is constructed to match the pitch of spring 22 to secure wide end extent 24 therein, it should be appreciated that other securement techniques, such as providing cross-threads or annular rings on the wall 42 of shell 20 may be provided. No threads at all may be employed where wide extent 24 actually skives into interior wall 42 for securement therewith. Narrow end extent 26 of spring 22 is secured in frictional relationship in a narrow generally cylindrical end portion 46*b* of bore 44. The free end of spring extent 26 is formed to about an inner surface on bore end portion 46*b* to provide a mechanical stop therebetween. Thus, in a manner well known in the twist-on connector art, spring 22 is in engagement with the internal wall 42 of shell 20 at both wider end extent 24 and narrow end extent 26. Tapering central extent 28 is generally spaced from interior wall 42 of shell 20 to define a free spring extent which is capable of radial expansion upon screw termination of connector 10 onto conductors 12** (FIG. 7).

Figure 4:
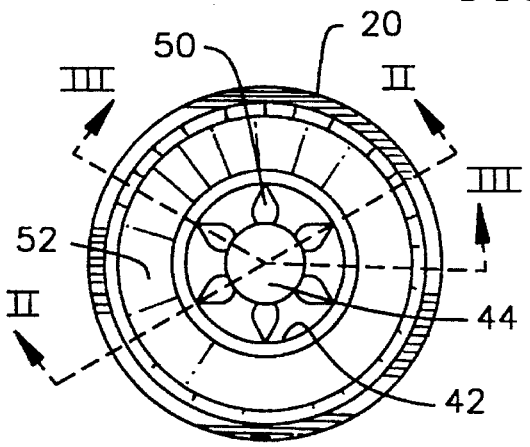
FIG. 4 is a bottom plan view of the connector shell of FIG. 1.

Referring now to FIGS. 2–4, the present invention provides by way of construction of internal wall 42 of shell 20 the ability to control the radial expansion of the central extent 28 of coil spring 22. Internal wall 42 adjacent frustro-conical upper portion 34 includes a plurality of circumferentially spaced ribs 50. Each rib 50 is an elongate member extending from portion **46*b* to threaded portion 46*a* of bore 44. Each rib 50 is generally inwardly radially directed toward central extent 28 of coil spring 22. As shown in FIG. 2, the distal radial extent of rib 50 is positioned such that space 46*c* is maintained between ribs 50 and central extent 28 of spring 22 so that central extent 28 maintains its free spring construction. As shown in FIGS. 3 and 4, each rib 50 inwardly tapers along its longitudinal extent towards the open end 40 of shell 20. Also the height end thickens of the radial extent of each rib 50 tapers downward toward open end 40 of shell 20. Thus, rib 50 uniformly reduces in all dimensions to a point adjacent threaded portion 46*a***.

Referring now to FIGS. 8 and 9A–9D, the ability to control radial expansion of spring 22 by the particular construction of ribs 50 is shown and described. Each rib 50 is inwardly directed, extending generally along a radius, r of shell 20 emanating from a central origin point, O. The transverse cross-sectional shape of each rib 50 includes a base extent 53 lying along and attached to interior wall 42 and a pair of tapering sidewalls 54 and 56 having a height terminating at an apex or peak 58. In the configurations shown in FIGS. 8 and 9A–9D, the particular transverse cross-sectional shape of rib 50 is generally arcuate, however, other transverse cross-sectional shapes which emanate from a wider base and taper to a narrower peak or apex such as a triangle or trapezoid may also be employed.

Figure 8:
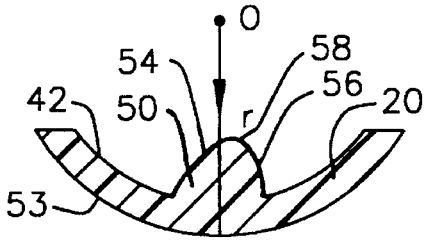
FIG. 8 is a sectional showing of a portion of the shell of FIG. 1.

In the embodiment shown in FIG. 8, the apex or peak 58, formed by the joining of tapered surfaces 54 and 56, is offset from the line defining radius, r and passing centrally through bore extent 53. Thus, tapered surface 54 is longer than tapered surface 56 so that apex 58 is disposed to one side of radius, r. Further, the line defining radius, r intersects rib 50 at a location along tapered surface 54 which is proximate of apex 58.

Figure 9A:
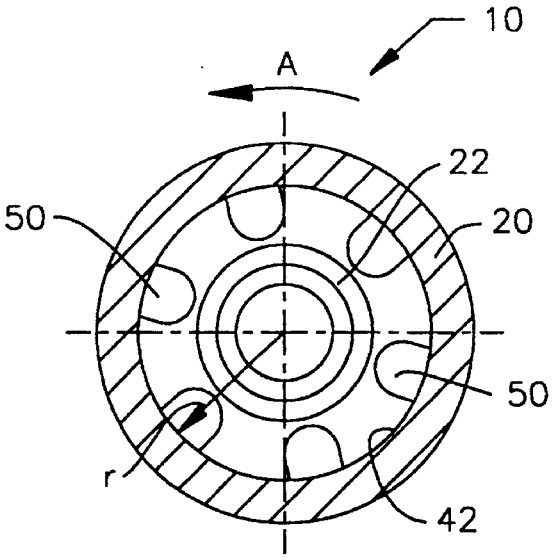
FIGS. 9A–9D show in schematic fashion, the effect on the shell ribs due to the radial expansion of the conductive coil spring of FIG. 1.
Figure 9B:
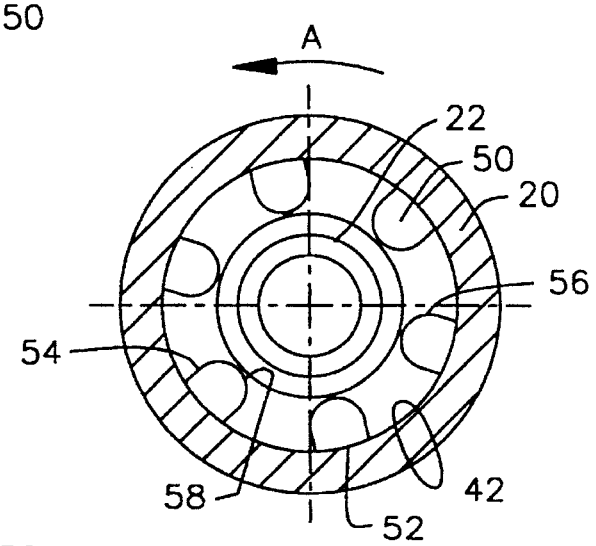
Figure 9C:
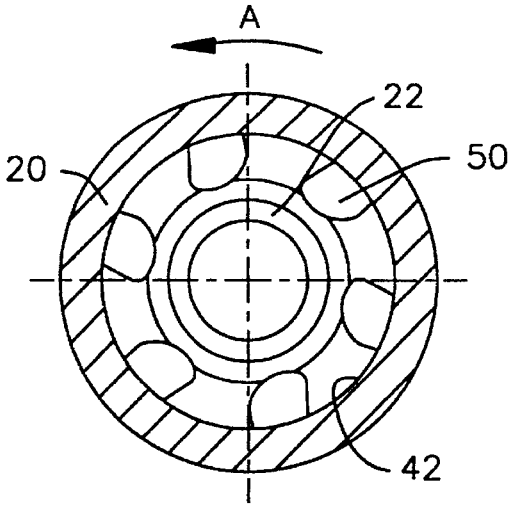
Figure 9D:
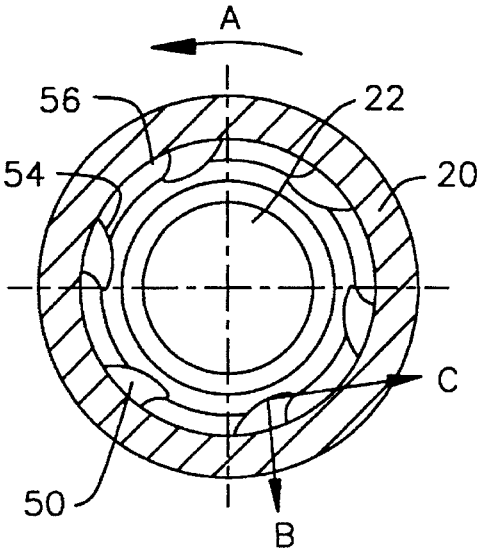

Referring specifically to FIGS. 9A–9D, schematically shown is the engagement of coil spring 22 with ribs 50 of shell 20. Generally it can be said that coil spring 22 expands circumferentially uniformly from central origin, O. Thus expansion takes place uniformly in a radially outwardly directed manner. As connector 10 is rotated about the conductors (not shown) in the direction of arrow A, coil spring 22 will radially expand. Such radial expansion is shown successively in FIGS. 9A–9D. As the radial expansion of coil spring 22 reaches ribs 50, radial expanding spring 22 will contact ribs 50 along longer tapered surface 54 at a location proximate of apex 58. Continued radial expansion of coil spring 22 will cause deformable engagement with ribs 50. However, since apex 58 is offset from the radius of expansion, ribs 50 will not only deform or crush in a radial direction (arrow B) but will also deform or deflect towards the shorter tapered wall 56 (arrow C). The effects of such radial expansion is shown in FIG. 9D. The particular construction of ribs 50 permits the dual deformation thereof and provides superior control of the expansion of coil spring 22. By controlling the expansion of coil spring 22 inward spring pressure is continually exerted on conductors 12 held within passage 30 of coil spring 22 (FIG. 2) so that intimate engagement is provided between the conductors 12 supported therein. It can be seen from FIGS. 9A–9D that such spring engagement is maintained regardless of the degree of spring expansion of coil spring 22. Thus, connector 10 of the present invention may be used to connect a wider range of conductor sizes as well as various numbers of conductors. Further, as ribs 50 are constructed to be skewed from the line of radius, r thereby controlling spring expansion, the twisting of connector 10 onto conductors 12 in the direction of arrow A is more easily facilitated.

Figure 5:
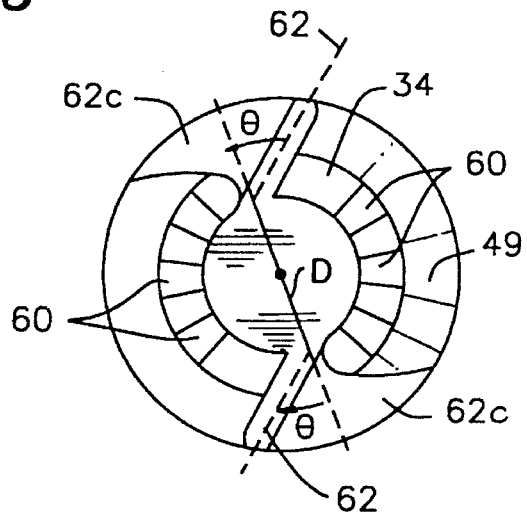
FIG. 5 is a top plan view of the connector of FIG. 1.
Figure 6:
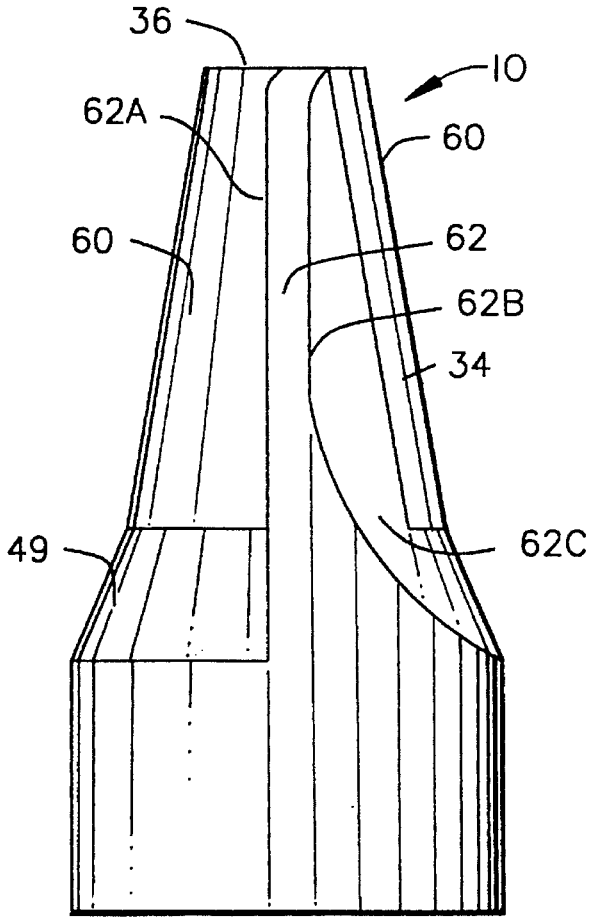
FIG. 6 is a side elevational showing of the connector of FIG. 1.

Referring now specifically to FIGS. 5, 6 and 7 in order to further assist the installer in twisting the connector 10 onto conductors 12 the present invention provides upper portion 34 of shell 20 with a plurality of longitudinally extending transversely spaced grooves 60 therealong. Grooves 60 extend from closed upper end 36 to transition region 49 to provide a tactile grasping surface which may be easily grasped and held by the installer. Grooves 60 may be of sufficient depth and spacing to provide a rough feel between the fingers of an installer.

Additionally, shell 20 includes a pair of generally diametrically opposed wings 62 extending outwardly from upper portion 34. As shown in FIG. 6 wings 62 extend longitudinally from upper surface 36 to and including the transition region 49 terminating at the upper extent of cylindrical portion 38. With additional reference to FIG. 5, wings 62 extend generally outwardly from locations at opposite ends of diameter, D. Wings 62 extend outwardly from such diametrically opposed locations at oppositely directed acute angles Θ from the diameter. Angle Θ is selected to be greater than 0° (lying along diameter D) so as to provide a more comfortable grip between the thumb and forefinger of the installer as shown in FIG. 7. Additionally, each wing 62 includes a pair of opposed surfaces, a first linear surface **62*a* and an opposed finger accommodating surface 62*b*. Finger accommodating surface 62*b* includes a lower extent 62*c* which curves outwardly and away from linear surface 62*a* providing an increased wing thickness thereat. The thickness of wing 62 adjacent curved extent 62*c* as well as the particular shape thereof provides a location which can be easily gripped by the installer as it ergonometrically conforms to the fingers of the installer as shown in FIG. 7 to facilitate the ease of twisting the connector 10 onto conductors 12 in rotational direction A. This allows the installer to make numerous terminations in a short period of time without experiencing discomfort or fatigue as the shape and size of the wings facilitates twisting connector 10 onto conductors 12**.

It should now be appreciated that the preferred embodiments described herein, particularly the rib construction, allow the use of a spring having a reduced wire cross-section as a result of the mechanical support provided by the ribs. Various changes to the foregoing described and shown structures would now be evident to those skilled in the art. Accordingly, the particularly disclosed scope of the invention is set forth in the following claims.

What is claimed is:

1. An electrical connector for connecting electrical conductors comprising:

an elongate shell having an open end, a closed end and an elongate axially extending cavity surrounded by an inner shell wall; and an elongate spring supported within said shell cavity, said spring being frictionally supported to said inner shell wall adjacent said open end and said closed end thereof and having a substantially unsupported longitudinal central portion extending therebetween and defining a passage for receipt of ends of said conductors, said central spring portion being radially expandable upon insertion of said conductors thereinto;

said shell further including a plurality of axially extending deformable ribs, each of said ribs having a transverse rib base along said shell wall and an inwardly tapering radially directed extent having a height which terminates at a rib peak, said inwardly tapering radially directed extent having first and second tapered surfaces extending from said shell wall to said rib peak, the first tapered surface being longer than the second tapered surface such that said rib peak is non-aligned with the line of the radius passing centrally through said transverse rib base, thereby providing a spring engagement surface along one tapering surface thereof to deform said ribs in both a radial direction and a transverse direction toward said second tapered surface.

2. An electrical spring connector of claim 1 wherein said shell is generally of frustro-conical shape tapering toward said closed end.

3. An electrical spring connector of claim 2 wherein said spring includes a narrow end supported adjacent the closed end of said shell and a wider end supported adjacent said open end of said shell.

4. An electrical spring connector of claim 3 wherein said shell and said spring are twisted onto said ends of said conductors.

5. An electrical spring connector of claim 4 wherein said ribs extend longitudinally from said closed end of said shell towards said open end and engage said unsupported central portion of said spring upon expansion thereof.

6. An electrical spring connector of claim 5 wherein said base portion of each of said ribs tapers in the longitudinal direction towards said open end.

7. An electrical spring connector of claim 6 wherein said height of each of said ribs decreases along the longitudinal extent thereof towards said open end.

8. A twist-on electrical connector for connecting electrical conductors comprising:

an elongate hollow shell having an inner generally cylindrical shell wall defining cavity open at one end;

a radially expandable generally hollow conical wire spring supported in the cavity for receipt of ends of said conductors; and a plurality of peripherally spaced deformable ribs inwardly radially extending from said inner shell wall and engageable with said wire spring to control the degree of radial expansion thereof;

each of said ribs having a cross-section which tapers inwardly in a generally radial direction to a distal extent and an initial spring engagement surface which is proximate of said distal extent, each of said ribs having a transverse rib base along said shell wall and an inwardly tapering radially directed extent having a height which terminates at a rib peak, said inwardly tapering radially directed extent having first and second tapered surfaces extending from said shell wall to said rib peak, the first tapered surface being longer than the second tapered surface such that said rib peak is non-aligned with the line of the radius passing centrally through said transverse rib base, thereby providing a spring engagement surface along one tapering surface thereof to deform said ribs in both a radial direction and a transverse direction toward said second tapered surface.

9. A twist-on electrical connector of claim 8 wherein said shell is an elongate member defining an elongate cavity, said wire spring being elongate and supported at either end thereof in said cavity by said shell wall.

10. A twist-on electrical connector of claim 9 wherein said wire spring member includes a central extent spaced from said inner shell wall.

11. A twist-on electrical connector of claim 10 wherein said ribs are elongate and extend axially along said shell wall, said ribs engaging at least a portion of said central extent of said wire spring upon expansion thereof.

12. A twist-on electrical connector of claim 11 wherein the cross-sectional shape of each of said ribs includes a tapering arcuate portion.

13. A twist-on electrical connector of claim 12 wherein said initial spring engagement surface lies along said arcuate portion of said rib.

* * * * *